US007690388B2

(12) United States Patent
Rogers

(10) Patent No.: US 7,690,388 B2
(45) Date of Patent: Apr. 6, 2010

(54) HAIR HOLDING DEVICE WITH ELASTIC CLOSURE OPERATION

(76) Inventor: Richard A. Rogers, 19 Bank St., Suite 406, Philadelphia, PA (US) 19106

( * ) Notice: Subject to any disclaimer, the term of this patent is extended or adjusted under 35 U.S.C. 154(b) by 534 days.

(21) Appl. No.: 10/763,870

(22) Filed: Jan. 23, 2004

(65) Prior Publication Data

US 2004/0149306 A1 Aug. 5, 2004

Related U.S. Application Data

(60) Provisional application No. 60/442,362, filed on Jan. 24, 2003, provisional application No. 60/483,143, filed on Jun. 27, 2003.

(51) Int. Cl.
*A45D 8/00* (2006.01)
*A45D 8/20* (2006.01)

(52) U.S. Cl. ..... 132/277; 132/276

(58) Field of Classification Search ..... 132/277, 132/273–276, 278–280, 126–129, 245
See application file for complete search history.

(56) References Cited

U.S. PATENT DOCUMENTS

| | | | | | |
|---|---|---|---|---|---|
| 1,533,380 | A | | 4/1925 | Burkhart | |
| 2,133,145 | A | * | 10/1938 | Jones | 132/277 |
| 2,201,719 | A | | 5/1940 | Eicher | |
| 2,426,258 | A | | 8/1947 | Casazza, Sr. | |
| 2,641,266 | A | | 6/1953 | Thatcher | |
| 3,358,698 | A | * | 12/1967 | Blanchard | 132/252 |
| 4,554,934 | A | * | 11/1985 | Mooneyhan | 132/245 |
| 5,494,060 | A | | 2/1996 | Potut | |
| 5,520,201 | A | | 5/1996 | Hart | |
| 5,535,765 | A | * | 7/1996 | Takashima | 132/273 |
| 5,642,740 | A | | 7/1997 | Chen | |
| 5,664,591 | A | * | 9/1997 | Potut | 132/277 |
| 5,697,388 | A | | 12/1997 | Chang | |
| 5,735,296 | A | | 4/1998 | Chen | |
| 5,787,905 | A | | 8/1998 | Yasuda | |
| 5,803,096 | A | * | 9/1998 | Lee | 132/277 |
| 5,842,482 | A | | 12/1998 | Potut | |
| 5,862,815 | A | | 1/1999 | Murphy | |
| 5,873,377 | A | | 2/1999 | Yang | |
| 5,988,184 | A | | 11/1999 | Shu | |
| 6,035,863 | A | | 3/2000 | Mao | |
| 6,142,159 | A | | 11/2000 | Lloyd | |
| 6,186,151 | B1 | | 2/2001 | Newlin | |
| 6,311,699 | B1 | | 11/2001 | Horman | |
| 6,325,074 | B1 | | 12/2001 | Strawn | |
| 6,357,452 | B2 | | 3/2002 | Bolito | |

(Continued)

FOREIGN PATENT DOCUMENTS

| | | |
|---|---|---|
| DE | 29821981 | 2/1999 |

*Primary Examiner*—Robyn Doan
(74) *Attorney, Agent, or Firm*—John F. Letchford; Archer & Greiner, P.C.

(57) ABSTRACT

Novel hair holding devices having first and second pivotally connected body members including hair gripping portions, and methods for improving existing such hair holding devices, in which the improvement involves providing the first and second body members with at least one elastomeric member for biasing the first and second body members into a closed position and for conforming to gathered strands of a user's hair when the hair gripping portions come into contact with gathered strands of a user's hair.

24 Claims, 14 Drawing Sheets

U.S. PATENT DOCUMENTS 6,360,752 B1 * 3/2002 Chang ..... 132/277
6,408,859 B1 6/2002 Shyu
6,453,911 B1 * 9/2002 Silva ..... 132/275
6,619,296 B2 9/2003 Potut

* cited by examiner

HAIR HOLDING DEVICE WITH ELASTIC CLOSURE OPERATION

CROSS-REFERENCE TO RELATED APPLICATION(S)

This application claims the benefit of U.S. Provisional Application No. 60/442,362, filed Jan. 24, 2003; U.S. Provisional Application No. 60/483,143, filed Jun. 27, 2003; and U.S. Provisional Application No. 60/490,812, filed Jul. 29, 2003.

FIELD OF THE INVENTION

The present invention relates to hair holding and hair styling devices in which a first body and a second body are pivotally connected and operable to grippingly engage a quantity of gathered hair strands.

BACKGROUND OF THE INVENTION

The hair holding device, or hair clip as it is popularly known, is perhaps the most prevalent of the hair holding/decorating/styling devices. Hinged, spring-biased devices for use in holding human hair are known in the art. Devices of this kind have been used for many years, and an early example is described in Eicher, U.S. Pat. No. 2,201,719. Such devices typically comprise a pair of opposed, hingedly connected members each including hair gripping and handle portions. The gripping portions are biased into a closed or gripping position by a torsion spring that exerts a closing force on the handle portions of the members. To deploy the device, the user squeezes the finger-pressable handle portions to overcome the biasing force of the spring and thereby separates the hair gripping portions. While maintaining the squeezing force, the user places the hair gripping portions on opposite sides of a desired quantity of hair to be held by the device. The user then releases the handle portions and the torsion spring urges the hair gripping portions into contact with a lock or shock of gathered hair.

In addition to the hair holding device described in U.S. Pat. No. 2,201,719, several U.S. patents propose hair holding devices either having bodies that are either too rigid to effectively hold hair or possess biasing springs, whether concealed or exposed, that may be aesthetically undesirable or otherwise unacceptable to many users. These include: Hart, et al., U.S. Pat. No. 5,520,201; Chen, U.S. Pat. No. 5,642,740; Yasuda, U.S. Pat. No. 5,787,905; Lee, U.S. Pat. No. 5,803,096; Potut, U.S. Pat. No. 5,842,482; Murphy et al., U.S. Pat. No. 5,862,815; Yang, U.S. Pat. No. 5,873,377; Shu, U.S. Pat. No. 5,988,184; Newlin, U.S. Pat. No. 6,186,151; Strawn, U.S. Pat. No. 6,325,074; Potut, U.S. Pat. No. 6,354,307; Bolito, U.S. Pat. No. 6,357,452; Shyu, U.S. Pat. No. 6,408,859 and Potut, U.S. Pat. No. 6,619,296.

The aforementioned hair holding devices suffer from one or more of the following disadvantages. They may have bodies that are too rigid to hold hair effectively and may therefore be incapable of optimally conforming to the contours of bunched hair in order to hold hair securely. As a result, they tend to become easily dislodged from the position they were intended to be placed about the user's hair. Further, if provided with biasing springs, whether exposed or concealed, they are not particularly aesthetically pleasing. In addition, if exposed, the springs tend to snag and damage the user's hair, as well as the user's fingers, when the user attempts to dislodge the device. Additionally, to the detriment of the service life of the device, the spring is often the first component of the device to fail. A spring also adds unwanted weight and volume to the device, and, due to its metal composition, is a comparatively expensive component. Additionally, from the standpoint of manufacturing, a spring adds complexity and cost to the assembly process.

Others have sought to improve the form and function of the hair holding device by supplanting the spring with alternative biasing means or by obviating the spring through innovative design. Patents issued for inventions of this type include: Mao, U.S. Pat. No. 6,035,863; Lloyd, U.S. Pat. No. 6,142,159 and Horman, U.S. Pat. No. 6,311,699.

Still others have proposed the use of hair holding devices involving the use of elastic bands in conjunction with rigid or flexible body members. Examples of such devices may be found in Takashima, U.S. Pat. No. 5,535,765 and Burkhart, U.S. Pat. No. 1,533,380.

The device of Takashima utilizes a pair of pivotally connected body members as a means for delivering and applying to the hair an elastic band for securing the hair. The rigid body members do not themselves possess any hair gripping portions. And, the elastic band does not bias the body members into a closed position. To the contrary, the elastic band biases the body members into an open position and the user must overcome that biasing force in order to close the device and place the band around a lock or shock of hair.

The Burkhart device is an arcuate hair comb and barrette combination. The device includes a unitary, planar, arch-shaped, hair comb formed from resilient material that includes no hinge. The comb is secured in the hair, in part, by elastic strands. The teeth of the comb penetrate a user's hair but the comb has no hair gripping portions. All of the hair containment function is performed by the elastic strands which cover only a small area of the contained mass of hair. The result is a device that can be operated in essentially only one way, i.e., it can be used to contain thick masses of bunched or folded hair but it cannot be used to effectively hold a single gathered lock or shock of hair such as a ponytail. That is, the Burkhart device would flatten the single gathered lock or shock of hair to an extent where the intended styling effect would be compromised and/or the hair comb would fall from the user's hair.

An advantage exists therefore for a versatile hair holding device which improves upon conventional hair holding devices by providing the first and second body members of the devices with elastomeric means for biasing the body members into a closed position and for conforming to gathered strands of a user's hair when the hair gripping portions come into contact with gathered strands of a user's hair.

SUMMARY OF THE INVENTION

The present invention provides a hair holding device comprising first and second pivotally connected body members with hair gripping portions, and methods for improving such existing hair holding devices, in which the improvement involves providing the first and second body members with elastomeric means for biasing the first and second body members into a closed position and for conforming to gathered strands of a user's hair when the hair gripping portions come into contact with gathered strands of a user's hair. The elastomeric means may be one or more elastomeric strands and/or bands permanently or removably connected to the device. The strands or bands may by connected to the first and second body members in linear, looped, wrapped and/or laced configuration.

The elastomeric means perform several distinct and important functions: biasing of the device's body members into a closed position (and thus the gripping members thereof into hair gripping contact with gathered strands of hair when received therebetween), conforming to the contours of the gathered strands of hair and pushing the gathered hair against the interior surfaces of the device's hair gripping portions and their gripping fingers. The result is a hair holding device that more securely holds hair than conventional hair holding devices in that the hair is substantially surrounded and firmly gripped on all sides by some portion of the device, i.e., either the hair gripping means of the body members (and/or and their gripping fingers) or the elastomeric means. The elastomeric means may thus supplant traditional biasing means such as a torsion spring while at the same time imparting better hair-securing capabilities to the device. The result is a less expensive, safer, more reliable and/or aesthetically pleasing device.

The elastomeric means may be retrofitted to existing biased devices to supplement their hair holding characteristics.

Alternatively, the elastomeric means be retrofitted to existing torsion spring biased devices so that their torsion springs, whether functional or not, may be removed whereby the devices may be converted into devices possessing only the elastomeric means as the body member biasing means.

According to a further embodiment, the present invention utilizes the elastomeric means in combination with fulcrum means provided on at least one of the device's body members for precluding erratic, jerky, or other uncontrolled movement of the device as its bodies pivot between closed and opened positions.

The elastomeric means and device of the present invention may be marketed in assembled condition or it may be sold as a kit to be assembled by the end user.

In addition, the present invention is directed to a variety of methods and means for connecting the elastomeric means to the bodies of the device.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
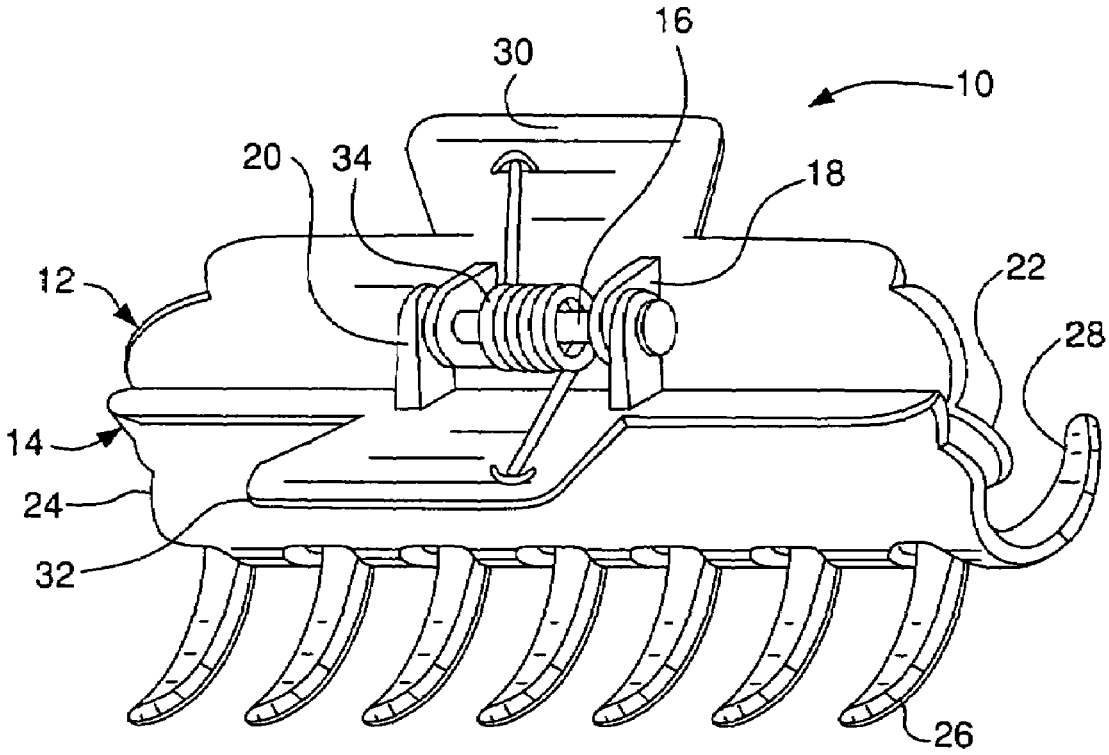
FIG. 1 PRIOR ART
FIG. 1 is a perspective view of a conventional hinged and spring-biased hair holding device.

Disclosed in FIG. 1 is a typical spring biased hair-holding device 10 comprising a pair of rigid body members 12 and 14 that are pivotally connected by a hinge pin 16 that passes through cooperating connecting lugs 18 and 20 carried by the rigid members. Members 12, 14 comprise handle portions 30 and 32 and hair gripping portions 22 and 24 which terminate in a plurality of interdigitated hair-engaging fingers or tines 26 and 28, respectively. A torsion spring 34 is disposed about the hinge pin 16. As is known in the art, the torsion spring is pre-stressed upon assembly of device 10 such that the projecting arms at its opposite ends exert force against the handle portions 30, 32 to urge the members 12, 14 into the illustrated closed position. Although somewhat useful for its intended purposes, the practical deficiencies of such a device are many, as enumerated hereinabove.

Figure 2:
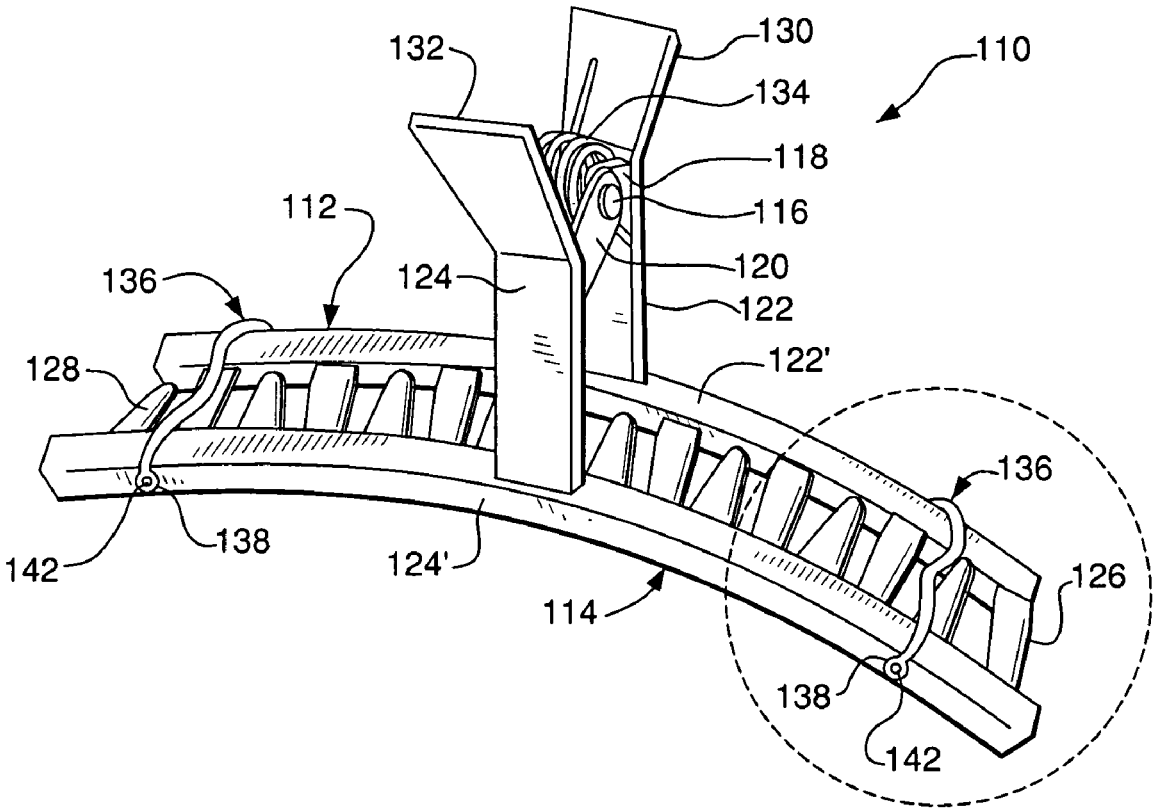
FIG. 2 is a perspective view of a hair holding device according to a first embodiment of the present invention in a fully closed position.
Figure 3A:
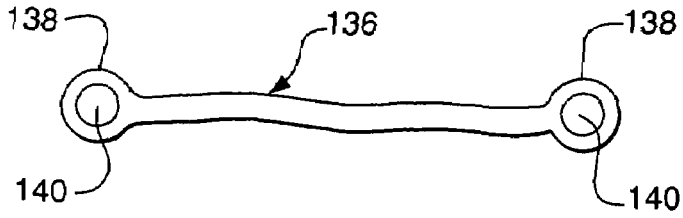
FIG. 3A is plan view of a first embodiment of an elastomeric means according to the present invention in an unstretched state.
Figure 3B:
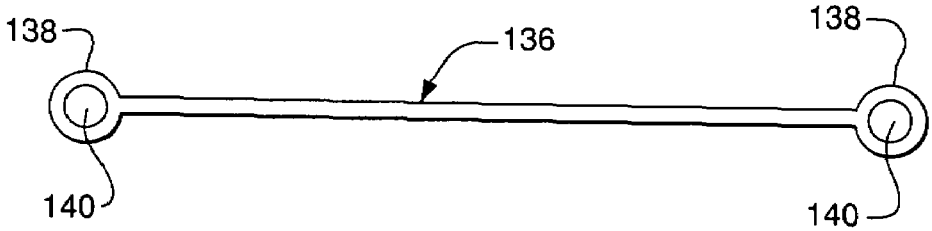
FIG. 3B is plan view of a first embodiment of an elastomeric means according to the present invention in a stretched state.

Referring to the drawings, FIG. 2 illustrates a first embodiment of a hair holding device constructed in accordance with the present invention and identified generally by reference numeral 110. Device 110 is in many ways structurally similar to device 10 shown in FIG. 1. More specifically, device 110 comprises a pair of rigid body members 112 and 114 that are pivotally connected by a hinge pin 116 that passes through cooperating connecting lugs 118 and 120 carried by the rigid members. Members 112, 114 comprise handle portions 130 and 132 and hair gripping portions 122, 122' and 124, 124' which terminate in a plurality of interdigitated hair-engaging fingers or tines 126 and 128, respectively. A biasing means 134 such as a torsion spring or the like is disposed about the hinge pin 116. The torsion spring is pre-stressed upon assembly of device 110 such that the projecting arms at its opposite ends exert force against the handle portions 130, 132 to urge the members 112, 114 into the illustrated closed position.

A significant distinction between conventional hair holding devices such as device 10 of FIG. 1 and those of the present invention, which distinction results in numerous performance and other advantages, is the provision of elastomeric means for connecting the first and second body members of the device. The elastomeric means according to the present invention may assume a variety of forms including, without limitation, at least one continuous elastomeric band and/or at least one finite length elastomeric strand having first and second ends. If made in the form of a strand, the elastomeric means may or may not have means at its first and/or second ends for removably or permanently connecting strand to the first and second body members of a hair holding device, e.g., members 112, 114 of device 110. If made in the form of a continuous band, the elastomeric means may or may not have means for removably or permanently connecting the band to the first and second body members of a hair holding device. Conversely, the first and second body members of a hair holding device may comprise means for removably or permanently connecting the elastomeric means. And, whether in strand or band form, the elastomeric means according to the present invention may be fabricated from any suitable elastic natural and/or synthetic material such as, for example, natural or artificial rubber or rubber-like compounds, latex, neoprene, spandex, or the like, that can withstand substantial elongation.

Figure 4:
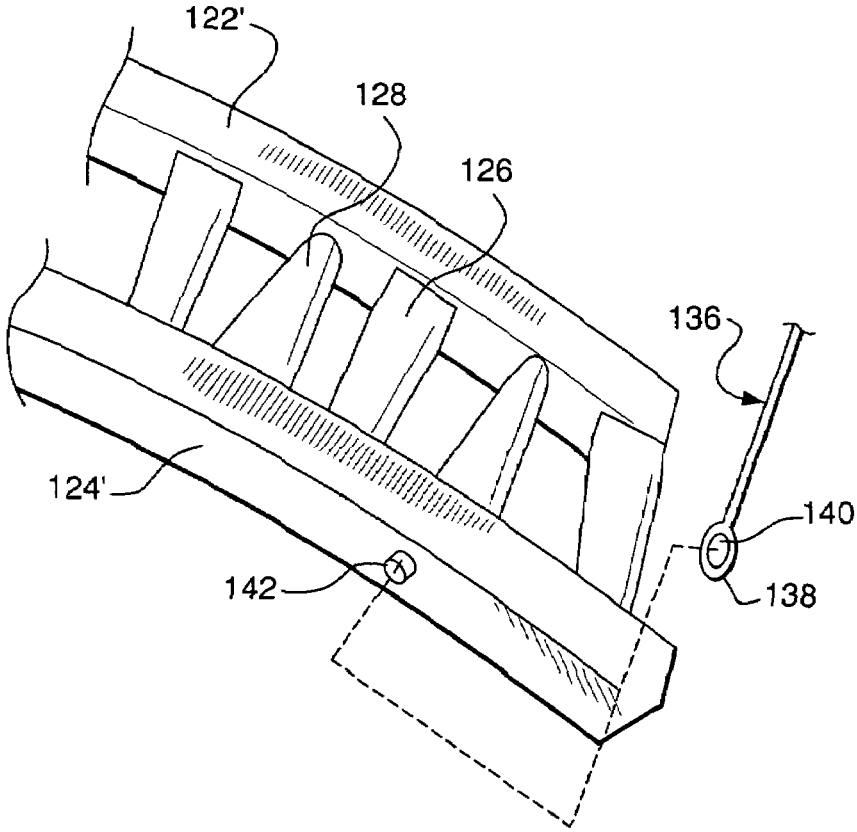
FIG. 4 is an enlarged and exploded view of the circled region of FIG. 2.

With the foregoing in mind, FIGS. 2-5 reveal that device 110 further comprises elastomeric means 136. The elastomeric means 136 according to this embodiment is manifested as a pair of elastomeric strands connected to hair gripping portions 122' and 124'. It will be appreciated, however, that as few as one strand or more than two strands may connect the first and second body members 112,114 and that it/they may be permanently or removably connected to structure of the first and second body members 112,114 other than hair gripping portions 122' and 124'. The elastomeric strands 136 may simply be tied and/or adhered to the opposed first and second body members 112,114 or, as most clearly shown in FIGS. 3A, 3B and 4, one or both of the first and second ends of the strands may include means 138 for attaching the strand to the first and second body members. As illustrated, attaching means 138 may assume the form of an eyelet or grommet defining an opening 140, although it may also be constructed in the form of a hook or similar releasable fastener. Attaching means 138 may be formed from the same or different material than the remainder of the strand, and it may be formed concurrently with the strand or be constructed as a discrete element that is later attached to the strand. FIGS. 1 and 4 show that the opening 140 in attaching means 138 is sized to receive a pin, knob, post or other anchorage means 142 carried by a respective one of hair gripping portions 122' and 124'.

Figure 5:
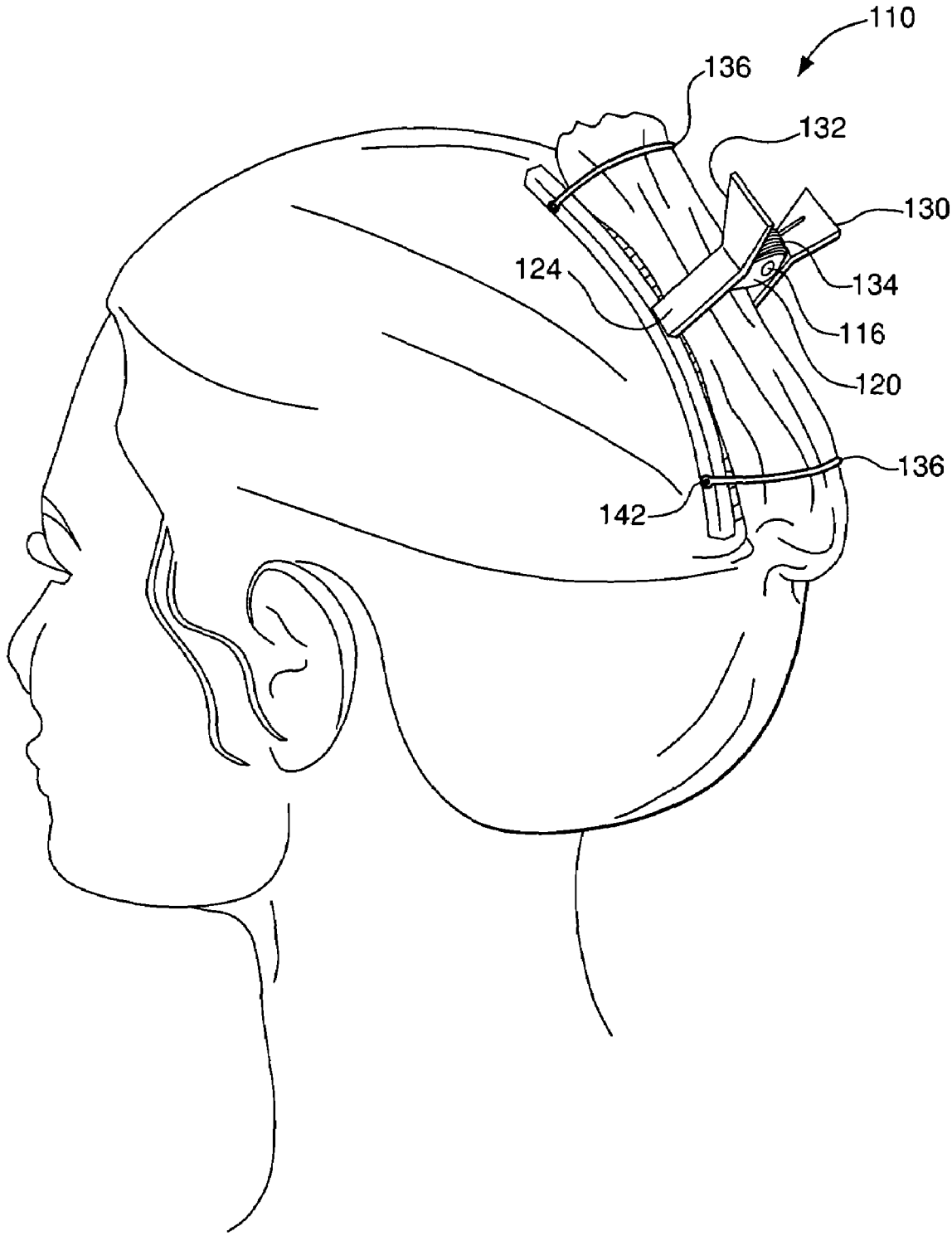
FIG. 5 is a perspective view of the hair holding device of FIG. 2 being worn in a user's hair.

Turning to FIG. 5, hair holding device 110 is shown being worn in a user's hair. In that figure, it is clearly seen that elastomeric means 136 conforms itself to the contours of a user's folded, bunched, twisted, rolled, spiraled, flipped and/or otherwise gathered hair. This capability, in addition to the other functions attributable to the elastomeric means described in greater detail in connection with FIG. 7C, results in a hair holding device that is better able to secure hair than the conventional hair holding device 10 of FIG. 1.

Figure 6:
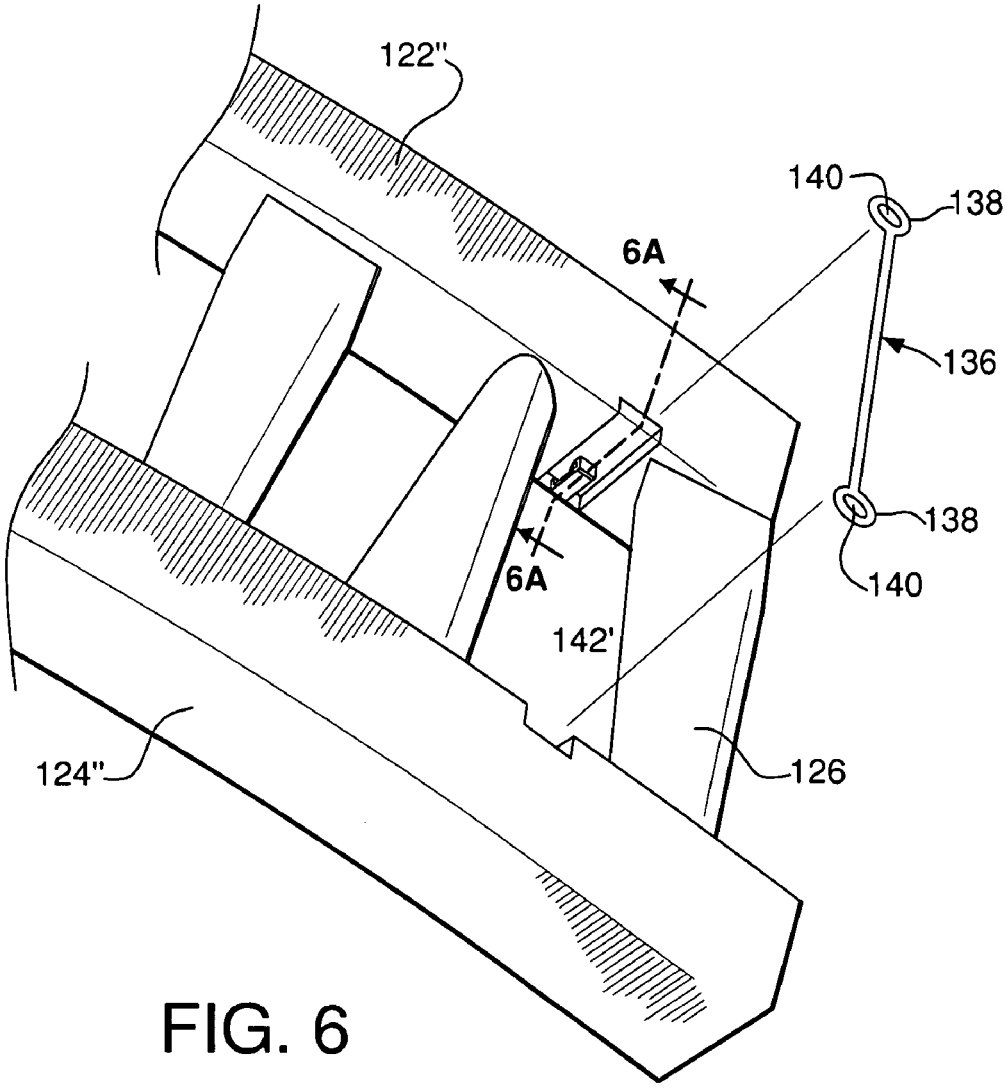
FIG. 6 is a enlarged perspective view of a portion of a hair holding device according to a further embodiment of the present invention in a fully closed position.
Figure 6A:
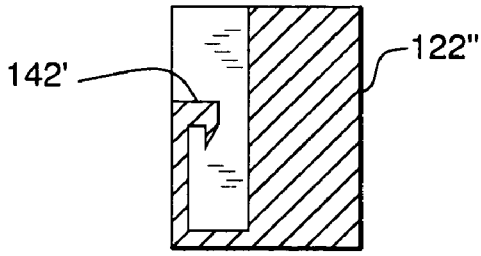
FIG. 6A is a cross-sectional view taken along lines 5A-5A of FIG. 5.

FIGS. 6 and 6A illustrate an alternative method and means for attaching elastomeric strand means 136 to the opposed hair gripping portions of a pivoted hair holding device, which hair gripping portions are identified by reference numerals 122" and 124". In this embodiment, the attaching means 138 at the opposite ends of elastomeric means 136 are attached to anchorage means 142' provided at the inner faces of hair gripping portions 122",124". As most clearly depicted in FIG. 6A, anchorage means 142' is a post-like member affixed to the opposed hair gripping portions. In order to secure elastomeric mean 136 to the hair gripping potions 122", 124", the openings 140 of attaching means 138 are simply slipped over the open end of anchorage means 142'. In order to enhance retention of the attaching means 138, it is preferred that anchorage means 142' be substantially C-shaped as reflected in FIG. 6A. An advantage of the construction shown in FIGS. 6 and 6A versus that of FIGS. 2-4 is that, with the anchorage means being disposed at the inner rather than the outer face of the hair gripping means, a simpler, more aesthetically pleasing design is achieved.

Figure 7B:
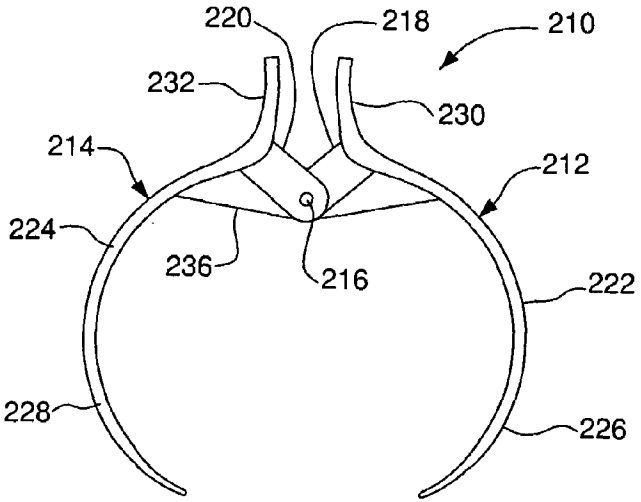
FIGS. 7A, 7B and 7C are respective end elevation views of a further embodiment of a hair holding device according to the present invention in closed, open and hair-gripping positions.
Figure 7C:
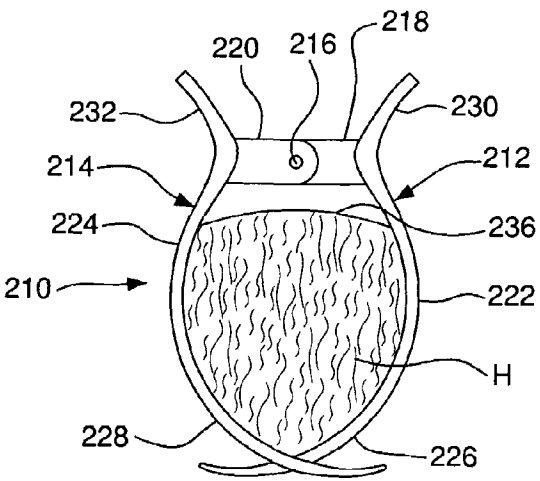
Figure 7A:
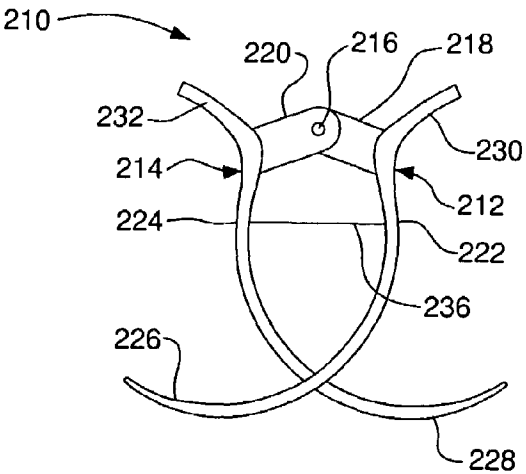

FIGS. 7A-7C reveal a further embodiment of a hair holding device according to the present invention and the general principles of operation of all hair holding devices incorporating elastic closure means as described herein. In those figures, there is shown a hair holding device, identified generally by reference numeral 210. Device 210 is in many ways structurally similar to the device 10 shown in FIG. 1 and device 110 of FIGS. 2-5. More specifically, device 210 comprises a pair of rigid body members 212 and 214 that are pivotally connected by a hinge pin 216 that passes through cooperating connecting lugs 218 and 220 carried by the rigid members. Connecting lugs 218 and 220 function as fulcrum means for elastomeric means 236, the benefit of which is discussed hereinafter. Members 212, 214 comprise handle portions 230 and 232 and hair gripping portions 222 and 224 which terminate in a plurality of interdigitated hair-engaging fingers or tines 226 and 228, respectively. Unlike the other embodiments of the invention thus far described, device 210 does not have a torsion spring for biasing the device into a closed position. That function is performed solely by elastomeric means 236, as described below. In addition, since a variety of elastomeric means and connectors that may be used in device 210 are described in other figures herein, and since graphic representation of their particular structural details would detract from the principles of operation portrayed in FIGS. 7A-7C, such details have been omitted from FIGS. 7A-7C for clarity of illustration.

FIG. 7A shows device 210 biased into a closed position by the tensile force generated by elastomeric means 236 connected to body members 212 and 214. FIG. 7B shows device 210 in an open position as it would appear when a user applies squeezing force against the outer surfaces of handle portions 230, 232 sufficient to overcome the tensile force of elastomeric means 236. As the device is transitioned from the position shown in FIG. 7A to that of FIG. 7B, the elastomeric means 236 is expanded and lifted by the body members 212, 214 in a direction toward the hinge pin 216 and connecting lugs 218, 220. With elastomeric means 236 so deployed, device 210 is poised to accept the user's hair. FIG. 7C is a view of device 210 in hair gripping position wherein the user has placed the hair gripping portions 222, 224 and their fingers 226, 228 on either side of a mass of gathered hair "H" and released handle portions 230, 232.

As device 210 moves from the position shown in FIG. 7B to the position shown in FIG. 7C, elastomeric means 236 contracts and is lowered into contact with hair H. In so doing, elastomeric means 236 performs several distinct and important functions: biasing of the device's body members 212, 214 into a closed position (and thus the hair gripping portions 222, 224 and associated fingers 226, 228 thereof into hair gripping contact with the gathered strands of the user's hair), conforming to the contours of the user's hair, and pushing the gathered hair H against the interior surfaces of the device's hair gripping portions and their gripping fingers. The result is a hair holding device that more securely holds hair than conventional hair holding devices in that the hair is substantially surrounded and firmly gripped on all or substantially all sides by some portion of the device, i.e., either the hair gripping portions and/or the associated fingers of the body members or the elastomeric means itself. As a consequence, elastomeric means 236 may be substituted for traditional biasing means such as torsion springs while at the same time imparting better hair-securing capabilities to the hair holding device. The result is a less expensive, safer, more reliable and/or aesthetically pleasing device.

Figure 8B:
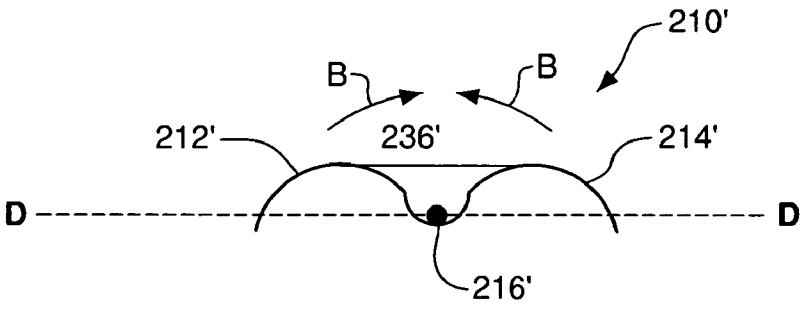
FIGS. 8A and 8B are schematic end elevation views demonstrating the effects on a hair holding device according to the present invention in which elastomeric closure means do not come into contact with fulcrum means.
Figure 8A:
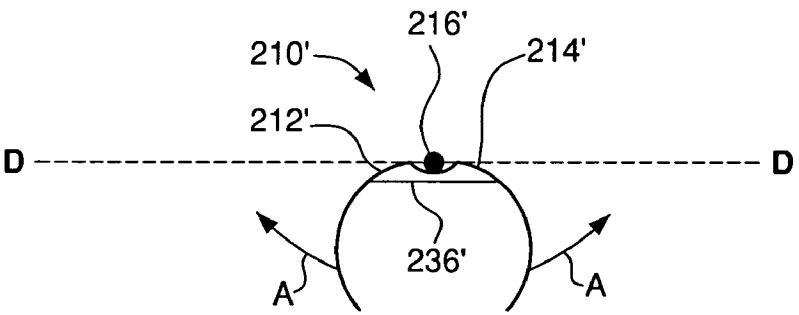

FIGS. 8A and 8B depict in schematic form a hypothetical hair holding device 210' constructed in accordance the present invention in which elastomeric closure means do not come into contact with fulcrum means such as those presented by the connecting lugs 218, 220 of FIGS. 7A-7C that contact the elastomeric means 236 in its path of travel from its lower contracted state shown in FIG. 7A to its upper expanded state shown in FIG. 7B. The following discussion is not relevant to the embodiment of the invention depicted in FIGS. 2-6, i.e., device 110, because the distance from the axis of hinge pin 116 to hair gripping portions 122', 124' is considerable, and therefore any danger of the elastomeric means passing the later-described "transition point' is avoided.

Referring to FIGS. 8A and 8B, only essential components of device 210' are included for clarity of illustration and simplicity and brevity of description. In that light, device 210' comprises first and second body members 212', 214' pivotally connected via a hinge pin 216'. Elastomeric means 236' biases the first and second body members together. Arrows "A" represent the motion of first and second body members 212', 214' as they are moved from a closed to an open position. Recall that as the first and second body members are opened, they expand and lift the elastomeric means in a direction toward the hinge pin. Broken lines D-D of FIGS. 8A and 8B represent a datum plane in which lies the hinge axis of hinge pin 216'.

Should elastomeric means 236' cross through the datum plane defined by line D-D, i.e., the "transition point", the elastomeric means would then bias body members 212', 214' in the direction of arrows "B" of FIG. 8B to a sprung-open position limited by contact between the body members or their handle portions. As elastomeric means 236' reaches the datum plane, it is at its most elongated state and therefore possesses its greatest potential energy. Consequently, if no fulcrum means are present, the device moves through the transition point with sudden acceleration—an acceleration that the user perceives as a jerky, erratic motion. This abrupt motion may be so pronounced and awkward that the user may lose her grip on and possibly drop the hair holding device while trying to open or close it.

Figure 9B:
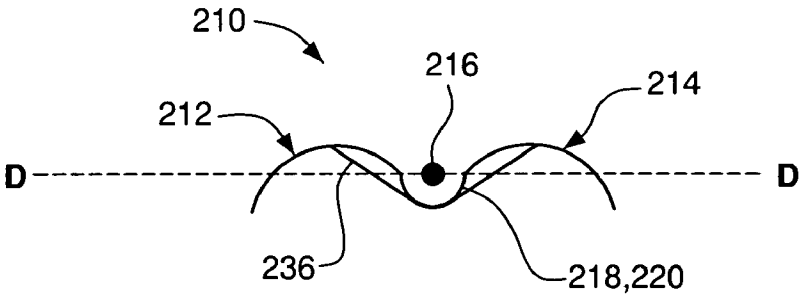
FIGS. 9A and 9B are similar to FIGS. 8A and 8B demonstrating the effects on a hair holding device according to the present invention in which elastomeric closure means come into contact with fulcrum means.
Figure 9A:
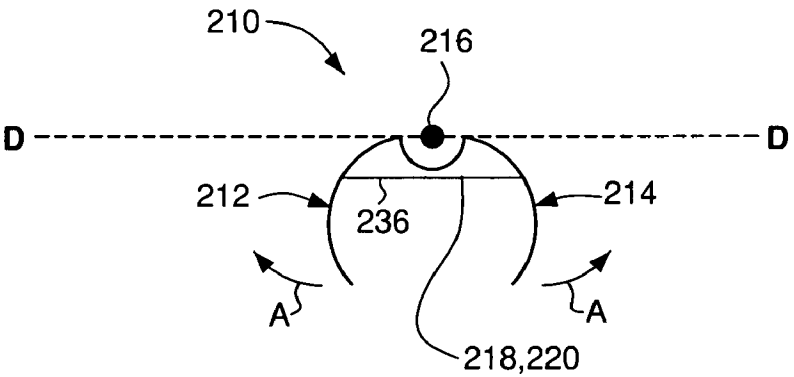

Referring to FIGS. 9A and 9B, there are shown schematic views of a hair holding device 210 constructed in accordance with FIGS. 7A-7C. Again, only essential components of device 210 are included for clarity of illustration and simplicity and brevity of description. Elastomeric means 236 biases first and second body members 212, 214 together. Again, arrows "A" represent the motion of first and second body members 212, 214 as they are moved from a closed to an open position. As they are opened, the first and second body members expand and lift elastomeric means 236 in a direction toward the hinge pin 216. And, again, broken lines D-D of FIGS. 9A and 9B represent a datum plane in which lies the hinge axis of hinge pin 216.

The distal ends of connecting lugs 218, 220 are spaced from datum plane D-D and define fulcrum means or fulcra. Elastomeric means 236 comes into contact with the fulcrum means as device 210 is moved into its open position shown in FIG. 9B, thereby preventing the elastomeric means from passing through the transition point and the device 210 from reaching the sprung-open position of FIG. 8B.

The distance between elastomeric means 236 and the fulcra defined by lugs 218, 220 may be referred to as the fulcrum distance. The inventors have observed that if the fulcrum distance is comparatively small, the elastomeric means is brought into contact with the fulcrum means throughout a substantial period of the transition of the hair holding device from its closed to its open position. In that event, an essentially smooth and constant handle squeezing force is required to open the device. However, if the fulcrum distance is comparatively large, the elastomeric means comes into contact with the fulcrum means somewhat late in the transition of the device from the closed to open position. Under these circumstances, a relatively greater squeezing force will be required for much of the transition, followed by rapid acceleration to a relatively lesser force at the end of the transition (similar to the transition one experiences when drawing the string of a compound archery bow). This abrupt change in force required to open the device and the attendant rapid change in opening speed produces in the user a sensation not unlike that which the user would experience when device 210' passes through the transition point discussed in connection with FIG. 8B, which may cause the user to lose control of the device. The fulcrum distance can be reduced by increasing the distance from the datum plane D-D to the distal ends of the lugs 218, 220 or by installing the elastomeric means 236 closer to the lugs.

Moreover, although shown as being defined by the first and second member connecting lugs, suitable fulcrum means may be any one or more protrusions or other structural features carried by either or both of the first and second body members that extend from the hinge axis toward the elastomeric means and impinge upon the elastomeric means as the device is moved from its closed to open positions. The fulcrum means may be of the same or different material than the body members to which it/they are attached. According to a presently preferred embodiment, the fulcrum means are formed concurrently with their associated body member, e.g., such as during an injection, vacuum or other molding process.

Figure 10:
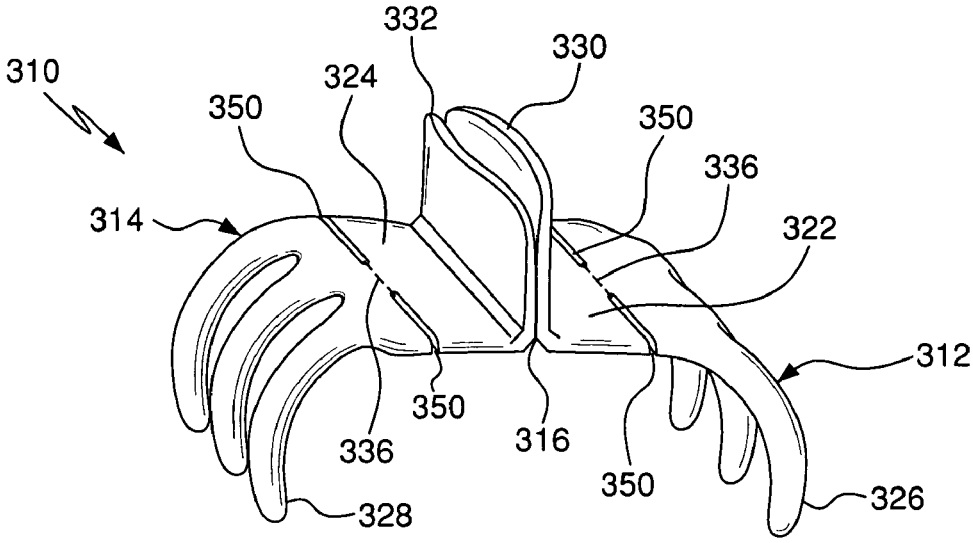
FIG. 10 is a top perspective view of a hair holding device according to a further embodiment of the present invention in a fully open position.
Figure 11:
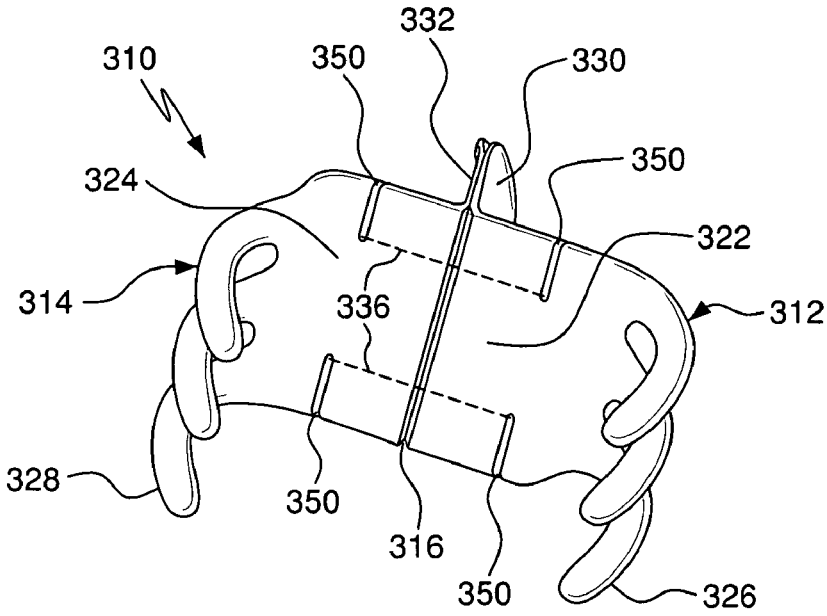
FIG. 11 is a bottom perspective view of the hair holding device of FIG. 10.

Thus far, all illustrated embodiments of the present invention show a hinge means comprised of a hinge pin that is received in cooperating lugs carried by a hair holding device's cooperating body members. It is also contemplated that the body members may be selected from suitable plastic materials and may be joined to one another during a plastic molding process so as to produce a flexible joint between them that is commonly referred to as a "living hinge." In that event, any suitable fulcrum means may also be formed concurrently with the device. An example of such a device is shown in FIGS. 10 and 11 and is identified generally by reference numeral 310.

Device 310 preferably comprises a pair of substantially rigid body members 312 and 314 that are pivotally connected via living hinge 316. Members 312, 314 comprise handle portions 330 and 332 and hair gripping portions 322, 324 which terminate in a plurality of interdigitated hair-engaging fingers or tines 326 and 328, respectively.

Hair holding device 310 includes elastomeric means anchorages 350 in the form of a plurality of slots provided in the outer lateral edges of the hair gripping portions 322, 324. Anchorage slots 350 are adapted to receive elastomeric means 336 (shown in dashed line in FIGS. 10 and 11) for biasing body members 312, 314 into a closed position. As shown, elastomeric means 336 according to this embodiment is a continuous elastomeric band threaded between the slots across the outer surface of each of hair gripping portions 322, 324 (FIG. 10) and across the inner surfaces of the hair gripping portions (FIG. 11). Although not illustrated in FIG. 11, the inner surfaces of the hair gripping portions may be provided with one or more fulcrum means as described above which may impinge upon elastomeric means 336 to impart smooth motion to the device as the user squeezes handle portions 330, 332 to open device 310 from its closed position to the fully opened position shown in FIGS. 10 and 11.

Figure 12:
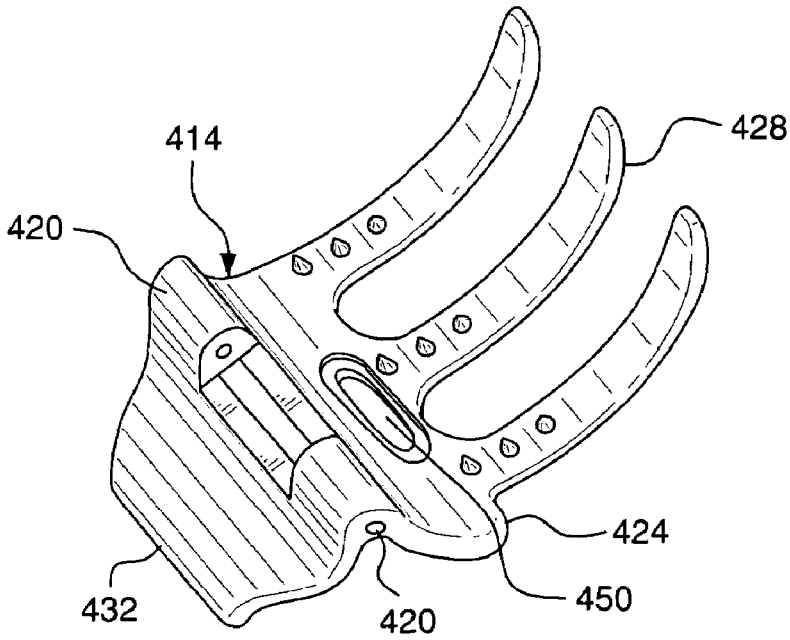
FIG. 12 is an inside perspective view of a body member of a hair holding device according to the present invention.

FIG. 12 is an inside perspective view of a rigid body member 414 of a further embodiment of a hair holding device according to the present invention. Body member 414 comprises connecting lugs 420 for cooperating with one or more connecting lugs of a mating but unillustrated body member. Member 414 comprise a handle portion 432 and a hair gripping portion 424 which terminates in a plurality of hair-engaging fingers or tines 428. The body member further preferably comprises a slot or other aperture 450 for removably or permanently receiving an elastomeric means anchorage as described below.

Figure 13:
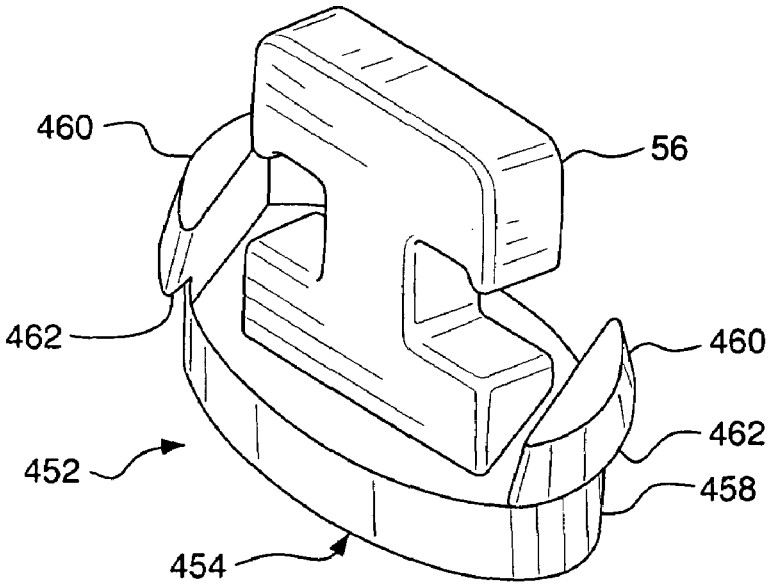
FIG. 13 is a perspective view of an elastomeric means anchor member suitable for use with the body member of FIG. 12.

FIG. 13 is a perspective view of an elastomeric means anchorage 452 suitable for use with body member 414 of FIG. 12. Anchorage 452 may be made of the same or different material than the body member of the device in which it resides. The anchorage includes a base portion 454 that is configured to substantially mate with aperture 450 of body member 414 and an elastomeric means engagement portion 456 to which elastomeric means according to the invention may be attached. Preferably, the base 454 of the anchorage has un upwardly tapering circumferential wall 458 for mating with a correspondingly tapered circumferential wall of aperture 450 of body member 414. In addition, a pair of latch means 460 desirably reside atop the base on opposite ends thereof. As the anchorage is pushed from the outer surface of body member 414 through aperture 450, the latch means 460 flex inwardly until outwardly projecting shoulders 462 thereof pass the inner surface of the body member, at which moment the latch means spring outwardly and secure the anchorage 452 to the body member 414. The stiffness of the latch means 460 determines whether the anchorage 452 is essentially permanently or removably connectable to the body member.

Anchorage 452 is but one of a virtually unlimited number of embodiments of elastomeric means anchorages that may be deployed in the hair holding devices of the present invention. The anchorages may or may not be integral parts of their associated body members. They may be of any size or shape according to what may be required to successfully achieve the objectives of biasing together the hair gripping means, restraining hair within the confines of the hair holding device, connecting the anchorages to the structure of the hair holding device and/or making the anchorages less visible and hair-safe. As shown in later figures, the anchorages may also include one or more holes through which elastomeric means may be threaded. Additionally described hereinafter, the anchorages may also include hooks fashioned on any part of the body member to which elastomeric means may be attached.

Furthermore, there exists a multiplicity of possible physical locations on the body member of a hair holding device where the anchorages may be located. There also exist a multiplicity of various ways in which anchorages may be constructed on or from the body member of a hair holding device. For instance, the anchorages could be made integral with or removable from the inside and/or outside surfaces of the handle portions, hair gripping portions, spring portions, lug portions, axle portions and/or the hair-holding teeth of a body member.

Figure 14:
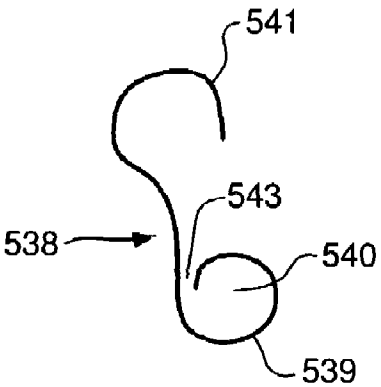
FIG. 14 is an elevation view of an elastomeric means attachment member according to the present invention.

FIG. 14 is an elevation view of an elastomeric means attachment member 538 according to the present invention. Attachment member 538 is preferably constructed as a unitary member including at one end an eyelet 539 defining an opening 540 and at the opposite end a hook 541. Attachment member 538 is particularly useful in connecting continuous band type elastomeric means to the body members of a hair holding device according to the invention. The continuous band elastomeric means is simply inserted through a gap 543 in eyelet 539 and is thereafter retained by the eyelet.

Figure 15:
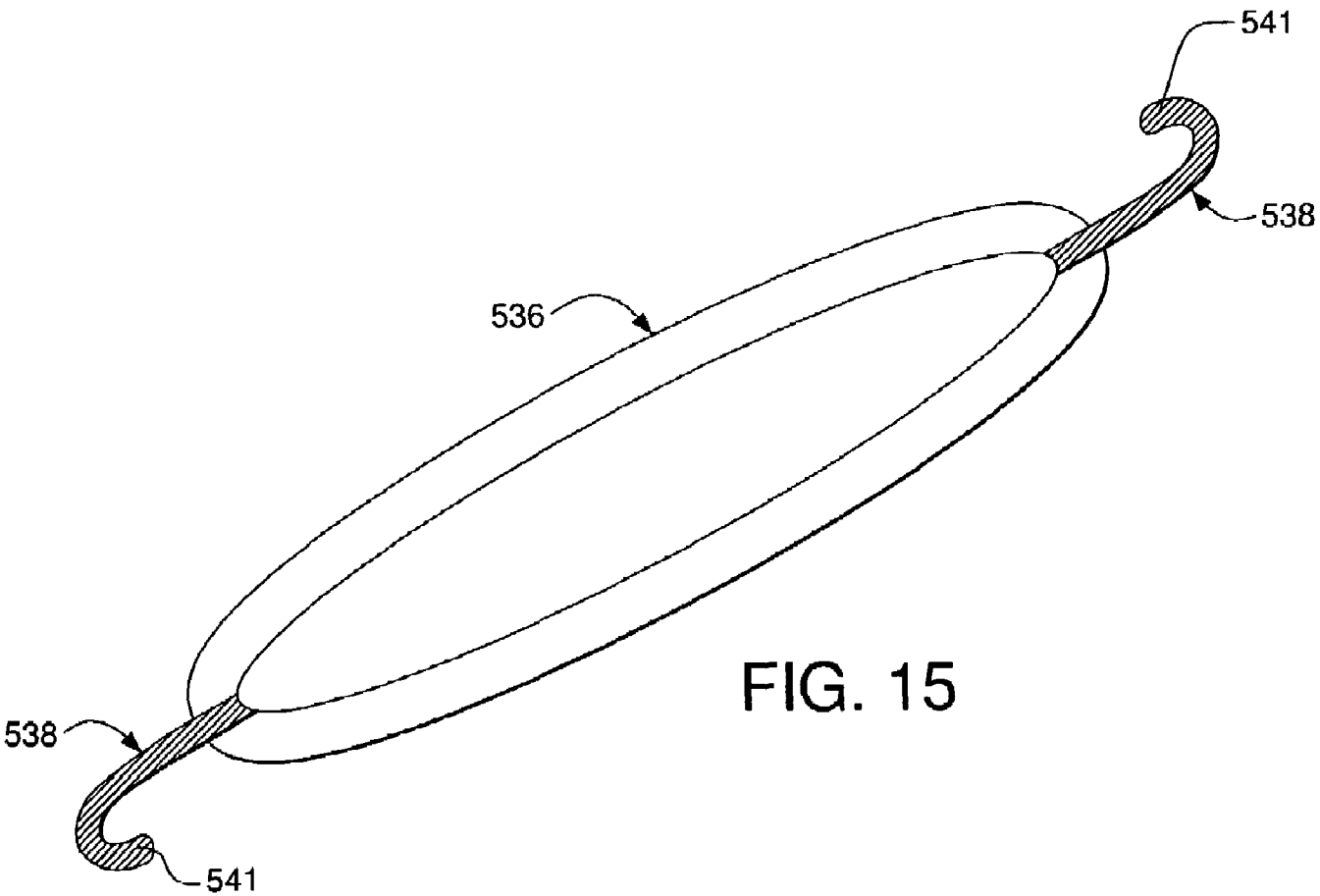
FIG. 15 is a perspective view of an elastomeric means carrying two of the attachment members of FIG. 14.

FIG. 15 is a perspective view of a continuous band elastomeric means 536 carrying two of the attachment members 538 of FIG. 14. Once the attachment members 538 are connected to the elastomeric means 536, one of the hooks can be connected to an anchorage on one of the first and second body members. Then, the continuous band elastomeric means can be secured to the first and second body members of a hair holding device in any desired manner of pattern. To complete the installation, the other of the hooks is connected to an anchorage on either of the first and second body members as may be appropriate.

The combined elastomeric means and attachment means combination of FIG. 15 is especially, although not exclusively, useful for retrofitting a conventional hair holding device of the prior art because it may be connected to the device without first disassembling the device. That is, a first hook 541 may engage or communicate with an advantageous anchorage component, such as the hinge pin, spring or lug of a hair holding device. The elastomeric means 536 may in turn communicate, be intertwined and/or wrapped advantageously through one or more hair-gripping means or other parts of one or both of the bodies to enable the elastomeric means to bias or to facilitate biasing of the body members toward one another to enable the elastomeric means to enhance securing of hair between the body members by conforming to and restraining the contours of the hair. Similar to the first hook, the second hook 541, if present, may likewise communicate with an advantageous anchorage component of the device.

FIGS. 16-19 illustrate several additional embodiments of hair holding devices of the present invention with certain elements thereof such as connecting lugs, hinge pins, and fulcrum means omitted for clarity of illustration.

Figure 16:
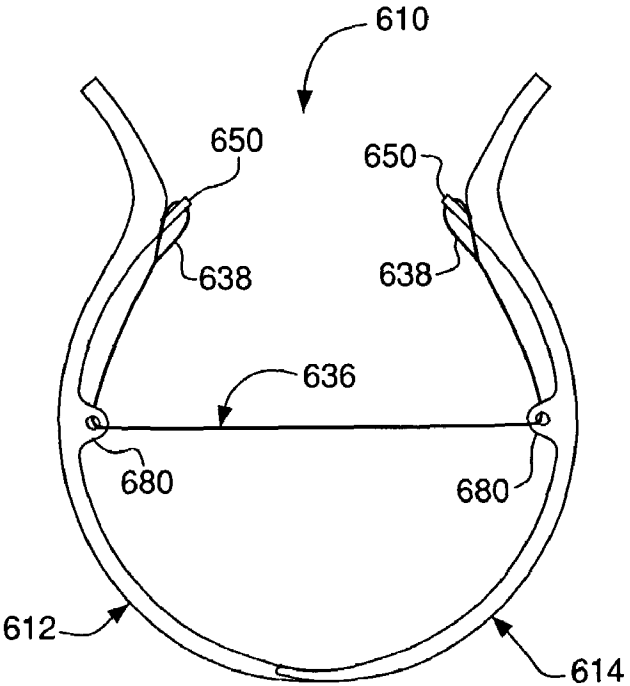
FIG. 16 is an end elevation view of a further embodiment of a hair holding device according to the present invention with certain elements omitted.

Device 610 of FIG. 16 comprises first and second body members 612, 614 and at least one elastomeric strand 636 for biasing the first and second body members into a closed position. Guide means in the form of an eyelet 680 is provided on opposed inner surfaces of each of the body members 612, 614. An end 638 of elastomeric means 636 passes through each eyelet and is secured to an anchorage 650.

Figure 17:
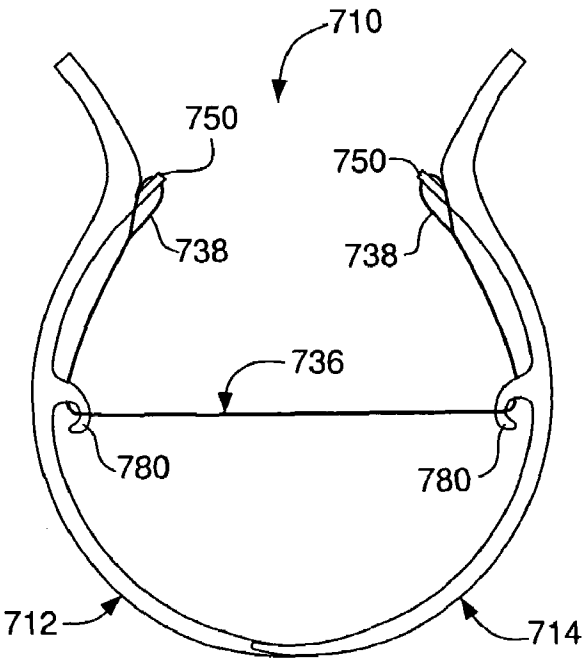
FIG. 17 is an end elevation view of a further embodiment of a hair holding device according to the present invention with certain elements omitted.

Device 710 of FIG. 17 comprises first and second body members 712, 714 and at least one elastomeric strand 736 for biasing the first and second body members into a closed position. Guide means in the form of hook 780 is provided on opposed inner surfaces of each of the body members 712, 714. An end 738 of elastomeric means 736 passes through each hook and is secured to an anchorage 750.

Figure 18:
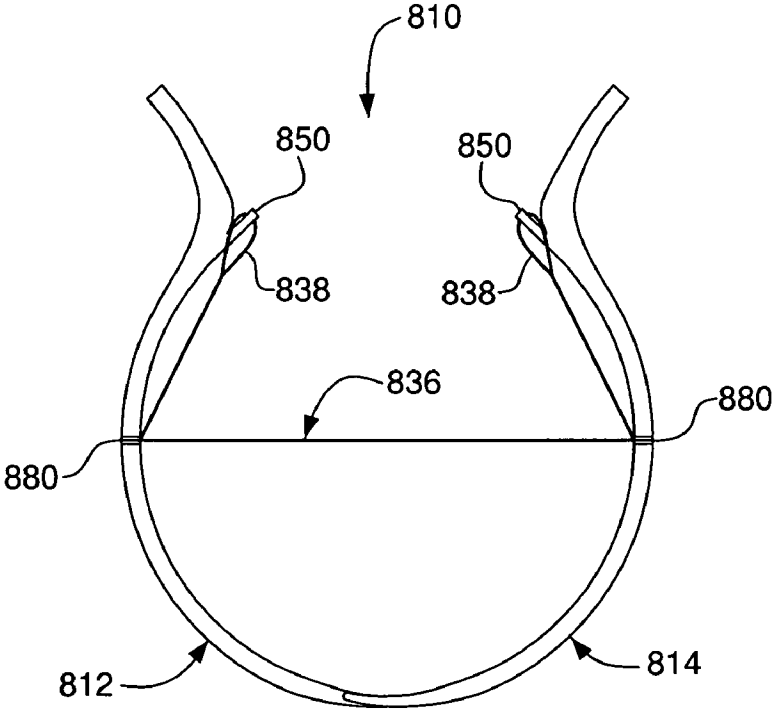
FIG. 18 is an end elevation view of a further embodiment of a hair holding device according to the present invention with certain elements omitted.

Device 810 of FIG. 18 comprises first and second body members 812, 814 and at least one elastomeric strand 836 for biasing the first and second body members into a closed position. Provided on the outer surface of the hair gripping tines of the first and second body members 812, 814 are guide means in the form of a recess or groove 880 around which passes an end 838 of elastomeric means 836. Each end 838 is secured to an anchorage 850. Preferably, grooves 880 are sufficiently deep that elastomeric means 836 is recessed below or flush with the outer surface of the tines.

Figure 19:
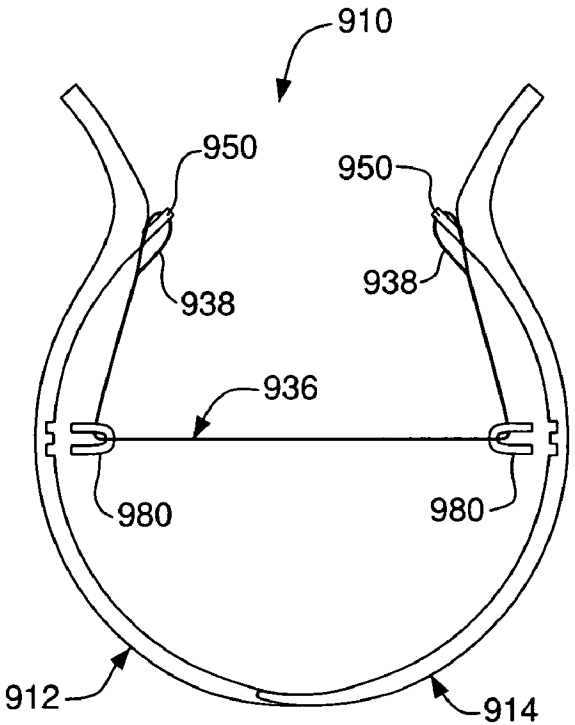
FIG. 19 is an end elevation view of a further embodiment of a hair holding device according to the present invention with certain elements omitted.

Device 910 of FIG. 19 comprises first and second body members 912, 914 and at least one elastomeric strand 936 for biasing the first and second body members into a closed position. On the inner surfaces of each of the body members 912, 914 there is provided guide means in the form of a snap-in hook or eyelet 980 through which passes an end 938 of elastomeric means 936. Each end 938 is secured to an anchorage 950. Preferably, guide means 980 snap firmly and permanently into the walls of the body members 912, 914.

Guide means 680, 780, 880 and 980 are preferably made as small as possible to avoid interference with the devices' ability to hold hair. Anchorages 650, 750, 850 and 950 may comprise any of the elastomeric means anchorages described above. Alternatively, anchorages 650, 750, 850 and 950 may be any structure inherent to a hair holding device which may be put to use as anchorage means, e.g., a handle portion, a connecting lug, a hair gripping tine, a biasing arm of a torsion spring, and so on.

FIGS. 20A-20F are cross-sectional views looking through the bottom of other hair holding devices according to the present invention depicting a few of a virtually infinite variety of patterns by which elastomeric means 1036 may be connected to the devices. Those devices, identified generally by reference numeral 1010, comprise first and second body members 1012, 1014 having hair gripping portions 1022 and 1024 which terminate in a plurality of interdigitated hair-engaging fingers or tines 1026 and 1028, respectively.

Figure 20A:
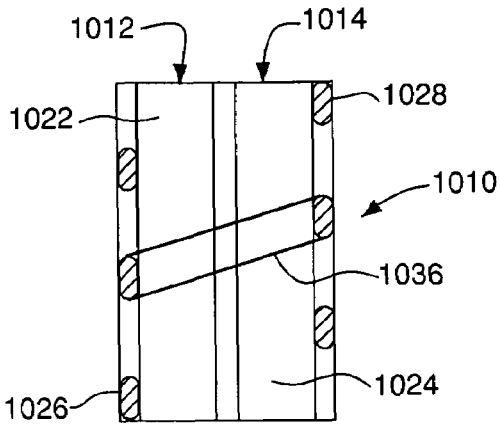
FIGS. 20A-20F are cross-sectional views of hair holding devices according depicting various patterns by which elastomeric means may be connected to the device.
Figure 20B:
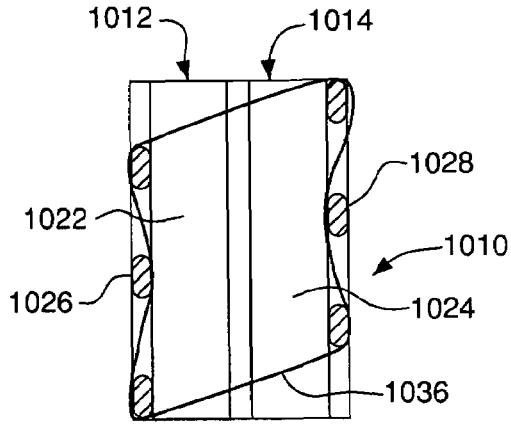
Figure 20C:
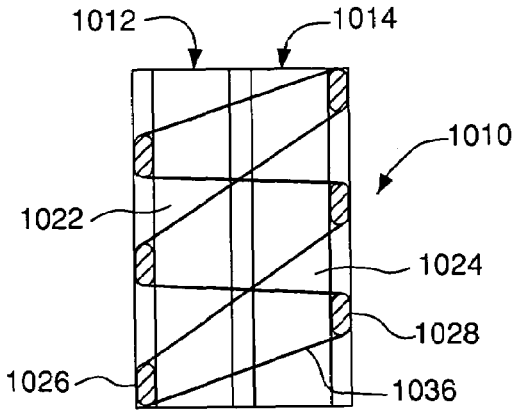

FIGS. 20A-20C illustrate several ways by which a single continuous band or finite strand elastomeric means 1036 may be connected to the device. FIG. 20A shows the elastomeric means contacting the first and second body members 1012, 1014 in a looped configuration. FIG. 20B shows the elastomeric means contacting the first and second body members 1012, 1014 in a partially-looped, partially-laced configuration. FIG. 20C shows the elastomeric means contacting the first and second body members 1012, 1014 in a laced configuration.

Figure 20D:
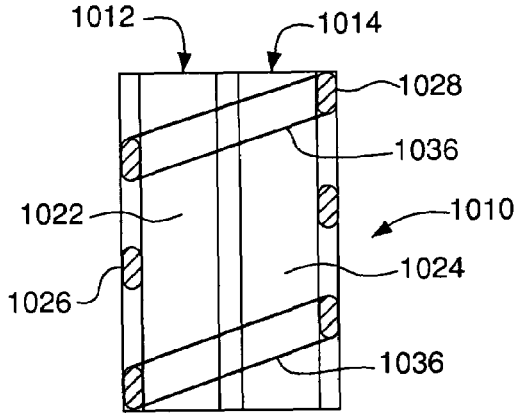
Figure 20E:
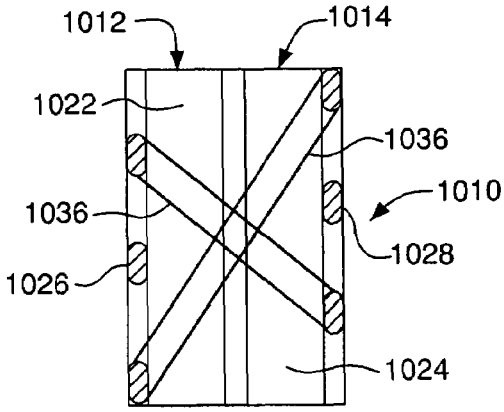
Figure 20F:
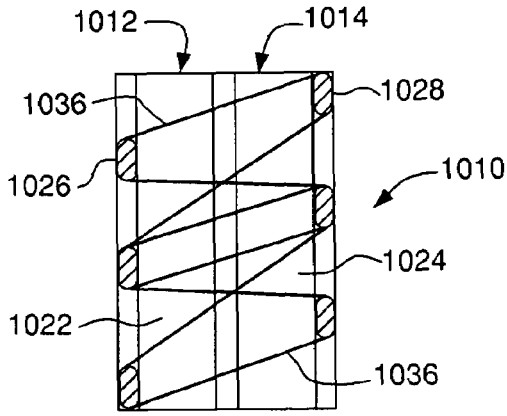

FIGS. 20D-20F illustrate several ways by which a two continuous band or finite strand elastomeric means 1036 may be connected to the device. FIG. 20D shows the elastomeric means contacting the first and second body members 1012, 1014 in parallel looped configurations. FIG. 20E shows the elastomeric means contacting the first and second body members 1012, 1014 in a cross-looped configuration. FIG. 20C shows the elastomeric means contacting the first and second body members 1012, 1014 in a laced configuration.

Although shown as being wrapped around mostly the outer surfaces of tines 1026, 1028 of the first and second hair gripping portions 1012, 1014, it will be appreciated that the elastomeric means 1036 may contact solely the inner surfaces, solely the outer surfaces or a combination of the inner and outer surfaces of the first and second body members. Also, the types and number elastomeric means used in hair holding devices constructed in accordance with the instant invention, their lengths, elasticities and materials are at the choosing of the assembler, so long as the benefits of the elastomeric means enumerated hereinabove are obtained. Furthermore, the elastomeric means may be permanently or removably attached to the body members at the time of their formation (i.e., during the molding process) or thereafter.

A major drawback of prior art devices, with hair gripping means biased together by a torsion spring, is the tendency of their torsion spring to fail. And, the torsion springs of those devices are not made for removal or replacement by consumers. After failure of the torsion spring, therefore, the devices of the prior art are useless, no longer viable for holding hair. In certain embodiments of the present invention, the elastomeric means is made for removal and/or replacement. Hence, the elastomeric means, perhaps after losing a certain degree of elasticity or otherwise failing, may be removed and replaced by the user with new elastomeric means. This is quite beneficial for users of hair holding devices in that the service lives of their hair holding devices may now be extended by simply removing and replacing the component most likely to fail, i.e., the biasing means. Rather than buying a new hair holding device whenever the biasing means fails, consumers need only install replacement elastomeric biasing means in accordance with the present invention that may be retrofitted onto their existing hair holding device.

According to another aspect of the present invention, a hair holding device and elastomeric means may be packaged and/or sold together as a kit whereby the end user may subsequently attach the elastomeric means to the hair holding device. The packaging may include descriptive and/or illustrative instructions suggesting how the elastomeric means may be placed in contact with the device to enhance the device's ability to secure hair. In the alternative, the end user may install the elastomeric means onto the device in a manner of the user's choosing.

Although the invention has been described in detail for the purpose of illustration, it is to be understood that such detail is solely for that purpose and that variations can be made therein by those skilled in the art without departing from the spirit and scope of the invention as claimed herein.

What is claimed is:

1. A hair holding device comprising:

a first body member and a second body member, said first and second body members comprising hair gripping portions;

hinge means for pivotally connecting said first and second body members; and elastomeric means in contact with said first and second body members for biasing said first and second body members only into a closed position and for conforming to gathered strands of a user's hair when said hair gripping portions come into contact with gathered strands of a user's hair.

2. The hair holding device of claim 1 wherein said elastomeric means comprise at least one finite length elastomeric strand having first and second ends.

3. The hair holding device of claim 2 further comprising means at said first and second ends for connecting said at least one elastomeric strand to said first and second body members.

4. The hair holding device of claim 2 further comprising means for permanently connecting said at least one elastomeric strand to said first and second body members.

5. The hair holding device of claim 2 further comprising means for removably connecting said at least one elastomeric strand to said first and second body members.

6. The hair holding device of claim 1 wherein said elastomeric means comprise at least one continuous elastomeric band.

7. The hair holding device of claim 6 further comprising means for permanently connecting said at least one elastomeric band to said first and second body members.

8. The hair holding device of claim 6 further comprising means for removably connecting said at least one elastomeric band to said first and second body members.

9. The hair holding device of claim 6 wherein said at least one elastomeric band contacts said first and second body members in a looped configuration.

10. The hair holding device of claim 6 wherein said at least one elastomeric band contacts said first and second body members in a laced configuration.

11. The hair holding device of claim 1 wherein said elastomeric means is permanently connected to said first and second members.

12. The hair holding device of claim 1 wherein said elastomeric means is removably connected to said first and second members.

13. The hair holding device of claim 1 further comprising additional means for biasing said first and second body members into a closed position.

14. The hair holding device of claim 13 wherein said additional means for biasing comprise a torsion spring having a first end in contact with said first body member and a second end in contact with said second body member.

15. The hair holding device of claim 14 wherein said first and second body members further comprise handle portions that are squeezable by a user to separate said hair gripping portions of said first and second body members, and wherein said first end of said torsion spring is in contact with said handle portion of said first body member and said second end of said torsion spring is in contact with said handle portion of said second body member.

16. The hair holding device of claim 1 wherein said first and second body members further comprise handle portions that are squeezable by a user to separate said hair gripping portions of said first and second body members.

17. The hair holding device of claim 1 wherein at least one of said first and second body members further comprise fulcrum means for contacting said elastomeric means and for easing opening and closing of said device as said first and second body members are moved between closed and open positions.

18. The hair holding device of claim 17 wherein fulcrum means comprise at least one protrusion extending from a hinge axis of said hinge means toward said elastomeric means.

19. The hair holding device of claim 18 wherein said at least one protrusion is at least one connecting lug of said hinge means.

20. A method of improving the hair holding capability of a hair holding device, said method comprising the steps of:

selecting a hair holding device comprising first and second pivotally connected body members, said first and second body members comprising hair gripping portions; and providing elastomeric means in contact with said first and second body members for biasing said first and second body members only into a closed position and for conforming to gathered strands of a user's hair when said hair gripping portions come into contact with gathered strands of a user's hair.

21. A hair holding device with an area for receiving gathered hair, comprising: a first body member and a second body member, said first and second body members comprising hair gripping portions; hinge means for pivotally connecting said first and second body members; and elastomeric means disposed at least between said first body member and second body member so as to define an area for receiving gathered hair and so as to bias said first and second body members toward closed position; wherein, while said first and second body members move from an open position, said elastomeric means moves toward contact with said hair.

22. A hair holding device with an area for receiving gathered hair, comprising: a first body member and a second body member, said first and second body members comprising hair gripping portions; hinge means for pivotally connecting said first and second body members; said hair gripping portions of said first body member and said second body member defining an area for receiving gathered hair; and elastomeric means in contact with said first and second body members for biasing said first and second body members only into a closed position and for conforming to gathered strands of a user's hair when said hair gripping portions come into contact with gathered strands of a user's hair; wherein said elastomeric means serves to reduce the volume of the hair-receiving area defined by the axial length of said first and second body members.

23. A hair holding device comprising: a first body member and a second body member, said first and second body members comprising hair gripping portions; hinge means for pivotally connecting said first and second body members; and elastomeric means in contact with said first and second body members for biasing said first and second body members only into a closed position and for conforming to gathered strands of a user's hair when said hair gripping portions come into contact with gathered strands of a user's hair; wherein said elastomeric means contacts inner surfaces of said first and second body members.

24. A hair holding device, comprising: a first body member and a second body member, said first and second body members comprising hair gripping portions; hinge means for pivotally connecting said first and second body members; and elastomeric means for biasing said first and second body members toward a closed position; said elastomeric means contacting at least one of said hair gripping portions and a portion of said elastomeric means disposed between inner surfaces of said first and second members; wherein, while said gripping portions move to an open position, said elastomeric means moves toward said hinge means; wherein, while said gripping portions move toward a closed position, said elastomeric means moves relative to said hair gripping portions so as to position a user's hair between said elastomeric means and said gripping portions.

* * * * *

UNITED STATES PATENT AND TRADEMARK OFFICE

CERTIFICATE OF CORRECTION

PATENT NO. : 7,690,388 B2
APPLICATION NO. : 10/763870
DATED : April 6, 2010
INVENTOR(S) : Bruce A. Rogers It is certified that error appears in the above-identified patent and that said Letters Patent is hereby corrected as shown below:

Title Page, At INID Code (76) on the front page, the inventor's name should be "Bruce A. Rogers".

Signed and Sealed this

Eleventh Day of May, 2010

David J. Kappos

David J. Kappos
*Director of the United States Patent and Trademark Office*